United States Patent [19]

Kuroki et al.

[11] Patent Number: 4,532,978

[45] Date of Patent: Aug. 6, 1985

[54] ROLL FOR TRANSFERRING HOT METAL PIECES

[75] Inventors: Hironori Kuroki; Tsuguo Honda; Toshihisa Mitsui, all of Fukuoka, Japan

[73] Assignee: Kuroki Kogyosho Co., Ltd., Kitakyushu, Japan

[21] Appl. No.: 600,211

[22] Filed: Apr. 16, 1984

Related U.S. Application Data

[63] Continuation of Ser. No. 382,446, May 26, 1982, abandoned.

[51] Int. Cl.[3] ..... B22D 11/128

[52] U.S. Cl. ..... 164/448; 75/126 F

[58] Field of Search ..... 164/448, 447, 442, 441; 29/132, 447, 129.5, 724; 75/126 F

[56] References Cited

U.S. PATENT DOCUMENTS

| | | | |
|---|---|---|---|
| 1,954,344 | 4/1934 | Becket et al. | 75/126 F |
| 3,997,373 | 12/1976 | Kazeva | 75/126 F X |
| 4,360,381 | 11/1982 | Tarutani et al. | 75/126 F |

FOREIGN PATENT DOCUMENTS

| | | | |
|---|---|---|---|
| 50-50229 | 5/1975 | Japan | 164/448 |
| 52-48521 | 4/1977 | Japan | 164/448 |
| 54-69522 | 6/1979 | Japan | 164/448 |
| 55-68161 | 5/1980 | Japan | 164/448 |
| 56-41355 | 4/1981 | Japan | 164/448 |
| 241689 | 8/1978 | U.S.S.R. | 75/126 F |
| 667607 | 6/1979 | U.S.S.R. | 75/126 F |

*Primary Examiner*—Kuang Y. Lin

[57] ABSTRACT

A roll for transferring hot metal pieces having excellent corrosion resistance, oxidation resistance, crack resistance and a long service life has a surface layer part made of ferritic steel containing less than 0.1 percent by weight of carbon, 10.0–14.0 percent by weight of chromium, 0.4–1.0 percent by weight of columbium and the balance iron.

10 Claims, 7 Drawing Figures

ROLL FOR TRANSFERRING HOT METAL PIECES

This application is a continuation, of application Ser. No. 382,446, filed May 26, 1982, now abandoned.

BACKGROUND OF THE INVENTION

This invention relates to a roll for transferring hot metal pieces such as ingots, slabs, blooms and billets of steel and other metals and alloys. A roll of low-mixed alloy steel having appropriate toughness is generally used as a roll for transferring hot metal pieces which is used for continuous casting or transferring other hot metal pieces. However, the above-mentioned rolls are remarkably worn away by oxidation at a high temperature caused by contact with metal pieces at high temperature when used as a continuous casting roll or by the corrosion of the rolls caused under the condition in an atmosphere of existing water or vapor of high temperature using extraneous cooling water.

Additionally, the repetitive thermal stress on the surface of the roll by repeated heating caused by contact with metal pieces at a high temperature and cooling by extraneous water, and the cracks which were caused by such repetitive thermal stress are problems also. A method for improving the corrosion resistance and the oxidation resistance of rolls is known which consists in adding alloy steel containing 10–14 percent by weight of chromium and some alloy constituents but the cracks which occurred in use were still not solved even though corrosion resistance and oxidation resistance were improved. Moreover, using a high-mixed alloy is detrimental as regards the cost of producing such rolls.

SUMMARY OF THE INVENTION

It is an object of the present invention to provide a roll for transferring hot metal pieces which roll has excellent corrosion resistance, oxidation resistance and crack resistance and wherein the possibility of use of the roll for long periods is improved.

The above-mentioned object of the present invention is achieved by making the surface layer part of a roll of ferritic steel containing essentially less than 0.1 percent by weight of carbon, 10.0–14.0 percent by weight of chromium, 0.4–1.0 percent by weight of columbium and the balance iron.

DESCRIPTION OF THE PREFERRED EMBODIMENTS

Figure 1:
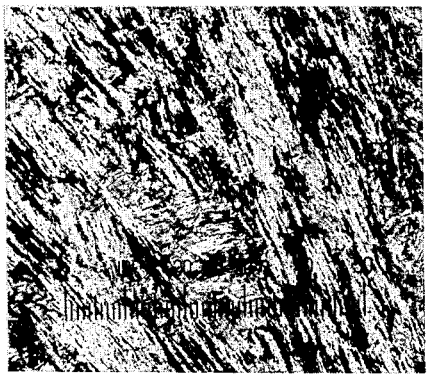
FIG. 1 to FIG. 6 show respectively photomicrographs of test pieces No. 1, No. 5, No. 10, No. 11, No. 19 and No. 21.

The present invention relates to a roll for transferring hot metal pieces such as ingots, slabs, blooms and billets of steels and other metals and alloys consisting of a Cr—Mo system of low-mixed alloy steel or an Ni—Cr—Mo system of low-mixed alloy steel for the underlayer part and the whole ferritic structure steel for the surface layer part. The composition of such surface layer part consists of less than 0.1 percent by weight of carbon, 10.0–14.0 percent by weight of chromium, 0.4–1.0 percent by weight of columbium and the balance essentially iron. The above-mentioned balance of iron means that is does not matter if it contains unavoidable minor amounts of impurities such as manganese or silicon in case of using the usual process.

Secondly, experiments and their results as regards properties which were required on the surface of a roll for transferring hot metal pieces are shown in the following.

Test pieces used in the experiments were cut out of a welded layer which had been formed on a steel plate by submerged arc welding the same as the buildup of welding on rolls practically. The chemical compositions of each test pieces and the mechanical properties which were measured after the heat treatment for the stress relieving at a temperature of 625° C. are shown in Table 1.

TABLE 1

| test pieces | chemical composition (percent by weight) | | | | | tension test | | | Vickers hardness | impact value |
|---|---|---|---|---|---|---|---|---|---|---|
| No. | C | Si | Mn | Cr | Cb | $\sigma_B$ | $\delta$ | $\phi$ | (500 g) | (Kgfm/cm$^2$) |
| 1 | 0.08 | — | — | 9.01 | — | 81 | 15 | 49 | 252 | 2.1 |
| 2 | 0.07 | 0.85 | 0.61 | 10.19 | — | 71 | 15 | 41 | 222 | 2.5 |
| 3 | 0.08 | — | — | 10.77 | — | 67 | 14 | 53 | 227 | 2.7 |
| 4 | 0.08 | 0.81 | 0.60 | 11.15 | — | 67 | 14 | 40 | 212 | 3.2 |
| 5 | 0.07 | 0.81 | 0.52 | 11.40 | — | 65 | 12 | 34 | 216 | 2.4 |
| 6 | 0.07 | 0.87 | 0.51 | 11.42 | — | 62 | 13 | 36 | 204 | 3.4 |
| 7 | 0.06 | 0.96 | 0.81 | 11.85 | — | 62 | 17 | 37 | 202 | 1.8 |
| 8 | 0.06 | 0.89 | 0.65 | 11.97 | 0.02 | 59 | 14 | 35 | 199 | 2.6 |
| 9 | 0.07 | 0.83 | 0.74 | 12.49 | — | 61 | 16 | 37 | — | 3.0 |
| 10 | 0.06 | 0.81 | 0.59 | 12.56 | — | 59 | 13 | 33 | 200 | 2.0 |
| 11 | 0.07 | 0.78 | 0.44 | 9.04 | 0.63 | 61 | 19 | 60 | 324 | 1.8 |
| 12 | 0.08 | 1.02 | 0.55 | 10.36 | 0.47 | 63 | 15 | 53 | 221 | 0.9 |
| 13 | 0.08 | 0.75 | 0.45 | 10.42 | 0.33 | 61 | 15 | 57 | 206 | 0.8 |
| 14 | 0.07 | 0.91 | 0.52 | 10.83 | 0.53 | 58 | 23 | 60 | 187 | 0.7 |
| 15 | 0.08 | 0.90 | 0.60 | 11.03 | 0.61 | 57 | 24 | 65 | 187 | 0.7 |
| 16 | 0.07 | 0.81 | 0.41 | 11.15 | 0.31 | 57 | 8 | 60 | 188 | 0.7 |
| 17 | 0.07 | 0.89 | 0.56 | 11.33 | 0.33 | 57 | 22 | 59 | 191 | 0.7 |
| 18 | 0.09 | 0.90 | 0.62 | 11.31 | 0.53 | 55 | 25 | 64 | 189 | 0.6 |
| 19 | 0.07 | 0.91 | 0.52 | 11.44 | 0.27 | — | — | — | 215 | 0.8 |
| 20 | 0.09 | 0.88 | 0.56 | 11.53 | 0.62 | 58 | 24 | 63 | 202 | 0.6 |
| 21 | 0.08 | 1.15 | 0.47 | 11.68 | 0.79 | 59 | 29 | 63 | 194 | 0.9 |

Additionally, in the above Table 1, $\sigma$B in the tension test presents the tension strength and its unit is Kgf/mm$^2$, $\delta$ presents the elongation and its unit is %, and $\phi$ presents the reduction of area and its unit is % (hereinafter referred to as the same).

Figure 2:
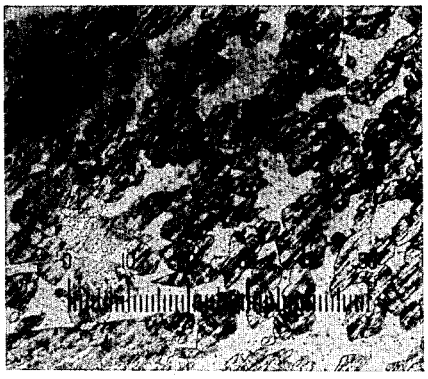
Figure 3:
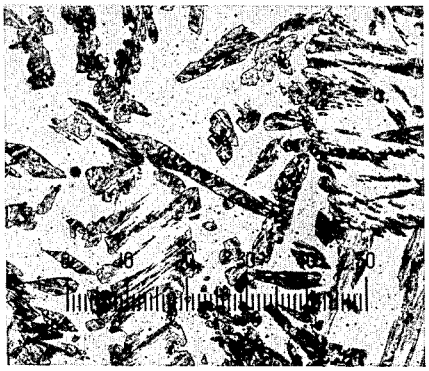
Figure 4:
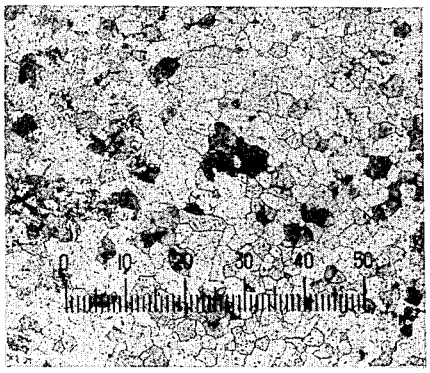
Figure 5:
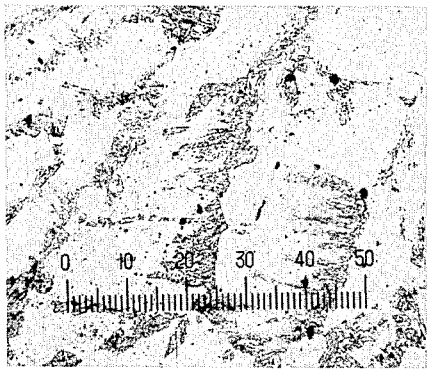
Figure 6:
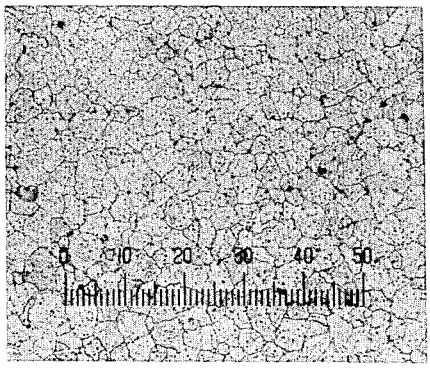

The photomicrographs of test pieces No. 1, No. 5 and No. 10 in the above-mentioned Table 1 are shown in FIG. 1 to FIG. 3 respectively, and the photomicrographs of test pieces No. 11, No. 19 and No. 21 which was ferritic by adding columbium are shown in FIG. 4 to FIG. 6 respectively.

The following is proved by FIG. 1 to FIG. 6, namely, test pieces which do not have added columbium have a martensite structure in the case of 9 percent by weight of chromium, but the rate of ferrite increases gradually with increasing chromium quantities; however, even with chromium quantities as low as 9 percent by weight, the test pieces have a complete ferritic structure with added columbium. The martensite structure is slightly present in test pieces in case of less than 0.3 percent by weight of columbium addition as shown in FIG. 5. Moreover, a completely ferritic structure in the present invention means that the matrix is wholly made of the ferrite structure, and also there is a precipitate such as carbide and others scattered in the matrix.

Secondly, in test pieces No. 1, No. 3, No. 11, No. 12 and No. 21, the impact values at high temperatures (300° C., 500° C.) are shown in Table 2, and $\sigma_B$, $\phi$ values in the tension test (500° C.) are shown in Table 3.

TABLE 2

| test piece number | temperature 300° C. | 500° C. |
|---|---|---|
| 1 | 4.0(Kgfm/cm$^2$) | 4.5(Kgfm/cm$^2$) |
| 3 | 6.5 | 6.8 |
| 11 | 4.9 | 3.9 |
| 12 | 12.2 | 13.0 |
| 21 | 14.8 | 14.9 |

TABLE 3 at 500$^2$ C

| test piece number | $\sigma_B$ | $\phi$ |
|---|---|---|
| 1 | 50 | 43 |
| 3 | 44 | 46 |
| 11 | 39 | 57 |
| 12 | 43 | 60 |
| 21 | 37 | 68 |

The following is proved by the results of experiments in Table 1 to Table 3.

In the material of completely ferritic structure containing of more than 10.0 percent by weight of chromium and further added columbium, its elongation and the reduction of area are both large, especially at high temperature, values of the elongation, the reduction of area and the impact value are remarkably larger than that of the material of the mixed structure of ferrite and martensite containing limited amounts of chromium and no columbium, and also the toughness of the material of the whole ferritic structure is larger than that of the material of the mixed structure. Furthermore, the changes in mechanical properties after heat treatment for stress relieving in test pieces No. 12 and No. 21 of the whole ferritic structure materials are shown in Table 4 and Table 5.

TABLE 4

| No. 12 | $\sigma_B$ | $\omega$ | $\phi$ | Vickers hardness (500 g) |
|---|---|---|---|---|
| as welded | 64 | 9 | 49 | 187 |
| annealed at 600° C. | 67 | 14 | 54 | 204 |
| annealed at 625° C. | 63 | 15 | 53 | 221 |

TABLE 5

| No. 21 | $\sigma_B$ | $\omega$ | $\phi$ | Vickers hardness (500 g) |
|---|---|---|---|---|
| as welded | 57 | 27 | 61 | 178 |
| annealed at 550° C. | 58 | 28 | 61 | 188 |
| annealed at 625° C. | 59 | 29 | 63 | 194 |

Generally, the mechanical strengh of the weld metal is lowered by heat treatment for stress relieving, but the material which forms the surface layer part of a roll in the present invention does not show a reduction of the mechanical strengh as shown in Table 4 and Table 5 that is, the hardness of the weld metal has a tendency to increase.

The above-mentioned fact shows the stability of the mechanical properties of the surface layer part of a roll even if that part is heated by touching with metal pieces at high temperature.

Secondly, the reasons for specifying the selected chemical components of the alloy for the surface layer part of a roll of the present invention are as follows.

Chromium is an indispensable alloy component to improve sites of wear resistance by corrosion and oxidation. An appropriate chromium quantity is more than 10 percent by weight of chromium for the following reasons.

One is that improvement in elongation and reduction of area by adding columbium are obtained by high chromium quantities as shown in Table 1. The other is that the effect columbium exerts on the improvement of high temperature impact values is not obtained with less than 10 percent by weight of chromium as shown in Table 2, No. 11. The resistance of the alloy of a roll to wear caused by corrosion and oxidation is improved with increasing chromium quantities. However, in the practical use of a roll, the possibility of brittleness at 475° C. owing to heating at a high temperature for a long time in the case of a content of more than 15 pecent by weight of chromium, so that it is necessary not to exceed 14 percent by weight of chromium.

Columbium increases elongation and reduction of area while improving wear resistance caused by corrosion and oxidation by making microstructures of a single phase of ferrite. Columbium remarkably improves the impact value at high temperatures, and is effective to prevent the occurrence and advance of cracks. Moreover, the mechanical strength of the alloy of a roll is stable without decreasing its hardness even if it was heated at a high temperature for a long time as shown in Table 4 and Table 5. The alloy of a roll containing less than 0.3 percent by weight of columbium does not have a completely ferritic structure but has the martensite structure shown in FIG. 5, No. 19 and lowering of elongation and reduction of area were caused by the above-mentioned small amount of columbium as shown in Table 1. A decrease in elongation might be caused with 0.3 percent by weight as shown in FIG. 5, so that it is necessary to have more than 0.4 percent by weight of as columbium. However, columbium generally decreases weldability, 1 percent by weight of columbium was found to be the maximum columbium content considering that minor amounts of columbium are enough to change the structure of the alloy to ferrite.

The amount of carbon should be enough to form a carbide in a minor amount. The mechanical strength of the alloy generally increases with increasing carbon quantity, but it is also necessary to keep the carbon content low since carbon decreases weldability. For the above-mentioned reasons, less than 0.1 percent by weight of carbon is enough for the purposes of this invention.

The following is an example of the present invention. A continuous casting roll to make a steel slab whose surface layer part is made of an alloy which contained 0.08–0.09 percent by weight of carbon, 11.76–12.00 percent by weight of chromium, balance iron, its useful life is shown in the following Table 6 compared with that of various kinds of comparative rolls.

TABLE 6

| rolls | features of rolls | useful life in thermal cycles |
|---|---|---|
| comparative rolls | Cr—Mo system low-mixed alloy | 7800 |
| | Ni—Cr—Mo—V system low-mixed alloy | 5500 |
| | Cr—Mo—V system steel build-up | 4950 |
| roll of the present invention | build-up of a layer part | over 10000 |

Figure 7:
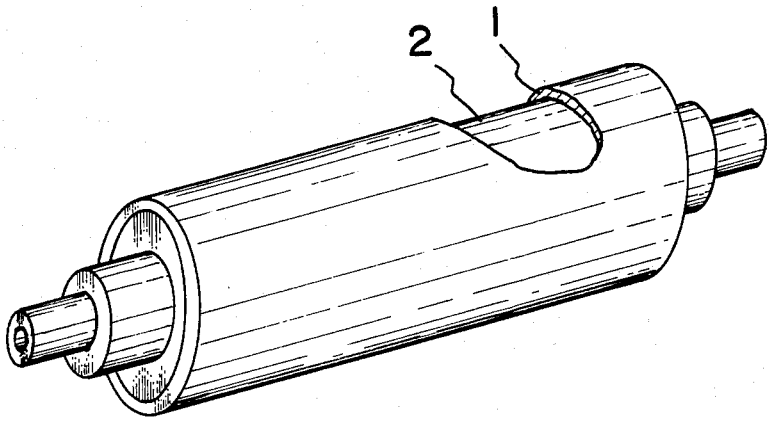
FIG. 7 shows a perspective view of a roll with a part broken away for purposes of illustration according to the present invention.

*Five rolls were tested with the present invention in the above Table, and all of them have shown values of more than 10,000 thermal cycles Additionally, FIG. 7 shows a perspective view of a roll with a part broken away in the present invention. (1) in FIG. 7 shows the surface layer of a roll, and (2) in FIG. 7 shows the under layer of a roll. As previously explained, a roll for transferring hot metal pieces according to the present invention has excellent wear resistance, corrosion resistance and oxidation resistance though its surface layer touches repeatedly metal pieces at high temperatures, and is used under conditions of atmospheres containing water and vapor at high temperatures because it is wholly made of ferritic steel. It is possible to improve substantially the useful life of the roll without using a roll wholly made of expensive high-mixed alloy since the material of the surface layer of the roll in the present invention has excellent resitivity to cracks because of its large values of elongation and reduction of area, and especially its large impact values at high temperatures.

Additionally, the surface layer part of the roll of the present invention may be formed usually by the following methods; build-up welding, thermal spraying, shrink fitting and the like.

What we claim is:

1. A roll for transfering hot metal pieces of which the surface layer part comprises a ferritic steel consisting essentially of less than 0.1 percent by weight of carbon, 10.0–14.0 percent by weight of chromium, 0.4–1.0 percent by weight of columbium and the balance iron.

2. The roll of claim 1, wherein said ferritic steel contains: from 0.08 to 0.09 percent by weight of carbon, and 11.76 to 12.00 percent by weight of chromium.

3. The roll of claim 1, wherein said ferritic steel contains in percents by weight:

| carbon | silicon | manganese | chromium | columbium |
|---|---|---|---|---|
| 0.07 | 0.78 | 0.44 | 9.04 | 0.63. |

4. The roll of claim 1, wherein said ferritic steel contains in percents by weight:

| carbon | silicon | manganese | chromium | columbium |
|---|---|---|---|---|
| 0.08 | 1.02 | 0.55 | 10.36 | 0.47. |

5. The roll of claim 1, wherein said ferritic steel contains in percents by weight;

| carbon | silicon | manganese | chromium | columbium |
|---|---|---|---|---|
| 0.07 | 0.91 | 0.52 | 10.83 | 0.53. |

6. The roll of claim 1, wherein said ferritic steel contains in percents by weight:

| carbon | silicon | manganese | chromium | columbium |
|---|---|---|---|---|
| 0.08 | 0.90 | 0.60 | 11.03 | 0.61. |

7. The roll of claim 1, wherein said ferritic steel contains in percents by weight:

| carbon | silicon | manganese | chromium | columbium |
|---|---|---|---|---|
| 0.09 | 0.90 | 0.62 | 11.31 | 0.53. |

8. The roll of claim 1, wherein said ferritic steel contains in percents by weight:

| carbon | silicon | manganese | chromium | columbium |
|---|---|---|---|---|
| 0.09 | 0.88 | 0.56 | 11.53 | 0.62. |

9. The roll of claim 1, wherein said ferritic steel contains in percents by weight:

| carbon | silicon | manganese | chromium | columbium |
|---|---|---|---|---|
| 0.08 | 1.15 | 0.47 | 11.68 | 0.79. |

10. The roll of claim 1, wherein said layer is formed by build-up welding, thermal spraying or shrink fitting over the underlayer of said roll.

* * * * *